US006749364B1

(12) United States Patent
Baker et al.

(10) Patent No.: US 6,749,364 B1
(45) Date of Patent: Jun. 15, 2004

(54) TEMPERATURE SENSING FOR CONTROLLING PAVING AND COMPACTION OPERATIONS

(75) Inventors: Adrian Baker, Charleston, IL (US); Timothy D. Williams, Gilbertville, IA (US); Stephen H. Malehorn, Charleston, IL (US); Craig L. Snyder, North Hero, VT (US)

(73) Assignee: Blaw-Knox Construction Equipment Corporation, Mattoon, IL (US)

( * ) Notice: Subject to any disclaimer, the term of this patent is extended or adjusted under 35 U.S.C. 154(b) by 0 days.

(21) Appl. No.: 09/979,428

(22) PCT Filed: May 19, 2000

(86) PCT No.: PCT/US00/13869

§ 371 (c)(1),
(2), (4) Date: Mar. 7, 2002

(87) PCT Pub. No.: WO00/70150

PCT Pub. Date: Nov. 23, 2000

Related U.S. Application Data

(60) Provisional application No. 60/134,791, filed on May 19, 1999.

(51) Int. Cl.[7] ..... E01C 23/07; E01C 19/22

(52) U.S. Cl. ..... 404/84.5; 404/84.05; 404/118

(58) Field of Search ..... 404/84.05, 84.1, 404/84.5, 118

(56) References Cited

U.S. PATENT DOCUMENTS

| | | | | | |
|---|---|---|---|---|---|
| 4,018,541 | A | * | 4/1977 | Denikin et al. | 404/130 |
| 4,347,016 | A | * | 8/1982 | Sindelar et al. | 404/95 |
| 4,826,326 | A | * | 5/1989 | Reynolds et al. | 374/5 |
| 5,327,081 | A | * | 7/1994 | Rudd et al. | 324/230 |
| 5,356,238 | A | * | 10/1994 | Musil et al. | 404/84.1 |
| 5,401,115 | A | * | 3/1995 | Musil et al. | 404/72 |
| 5,745,051 | A | * | 4/1998 | Doherty et al. | 340/905 |
| 5,839,829 | A | * | 11/1998 | Litvin et al. | 374/121 |
| 5,947,636 | A | * | 9/1999 | Mara | 404/84.05 |

* cited by examiner

*Primary Examiner*—Raymond Addie
(74) *Attorney, Agent, or Firm*—Michael Best & Friedrich LLP

(57) ABSTRACT

A pavement temperature monitoring system (10) is used on paver vehicle (12) that is capable of forming a pavement material mat (11) upon abase surface (13), as paver vehicle (12) travels generally in a single direction. A temperature sensor (14) can be either a thermal imager, a thermal scanner, or a thermal imager operating in line "scan" mode. The temperature sensor (14) is mounted on a rear end (12*a*) of the paver vehicle (12) in such a way that the entire width of the formed mat can be scanned or imaged. A display device (16) is capable of receiving a plurality of electrical signals from the thermal scanner generating and displaying a graphical image (17) of the formed mat temperature profile.

47 Claims, 10 Drawing Sheets

19 →

| | Cursor Temp | Max Temp | Min Temp | Avg Temp |
|---|---|---|---|---|
| LI01 | 266.0°F | 275.8°F | 263.2°F | 270.6°F |
| LI02 | 288.4°F | 279.8°F | 266.1°F | 274.0°F |
| AR01 | - | 270.7°F | 92.0°F | 265.6°F |
| SP01 | 272.2°F | - | - | - |

19

| | Cursor Temp | Max Temp | Min Temp | Avg Temp |
|---|---|---|---|---|
| LI01 | 278.6°F | 287.0°F | 267.0°F | 279.3°F |
| LI02 | 280.5°F | 285.0°F | 271.5°F | 279.6°F |
| AR01 | - | 288.9°F | 268.7°F | 280.8°F |
| SP01 | 281.7°F | - | - | - |

TEMPERATURE SENSING FOR CONTROLLING PAVING AND COMPACTION OPERATIONS

This-application claims the benefit of U.S. Provisional Patent Application Serial No. 60/134,791 filed May 19, 1999.

BACKGROUND OF THE INVENTION

The present invention relates to paver vehicles and compactor vehicles, and more specifically to systems for monitoring and controlling paver vehicles and compactor vehicles used for forming asphalt mats.

Paver vehicles or "pavers" capable of forming mats of material, such as asphalt, upon a base surface are well known. Such paver vehicles basically consist of a tractor and a screed assembly towed by the tractor. The tractor includes a tractor body and wheels and/or a pair of continuous tracks mounted to the tractor body for mobilizing the tractor to travel upon a base surface. The tractor also generally includes an operator station and a material hopper mounted to the front end of the tractor for holding a quantity of paving material. Further, a conveyor extends longitudinally between the hopper and the rear of the tractor and functions to transport paving material from the hopper to be deposited off the rear of the tractor. A rotatable auger is mounted to the rear of the tractor and operates to spread deposited paving material laterally across the base surface to form a head of paving material in front of the screed.

The screed assembly functions to level and compress the material head to form a continuous formed material mat on the base surface, generally in the form of an elongated strip, as the tractor travels forwardly upon the base surface. The screed assembly includes a main or primary screed and may include one or more extensions attached to the main screed, which may be fixed or extendable with respect to the main screed. The main screed and any extensions each include an upper frame and a lower screed plate attached to the frame, the screed plate providing the working surface for leveling (i.e., establishing formed material mat thickness), and generally also compressing, the paving material into a formed material mat.

Typically, the screed assembly includes one or more vibrators mounted on the upper surface of the screed plates which function to increase the compression or compressive force applied by the screed plates to the formed material mat during the leveling operation. Certain paver vehicles, particularly those used in countries where "low speed" paving is preferred, include one or more reciprocating tamper bar that are disposed forwardly of the screed plates. The tamper bars function to pre-compress the paving material prior to leveling by the screed plates.

In addition, many screed assemblies are provided with one or more mechanism(s) referred to as "screed assist device(s)," which includes one or more hydraulic cylinders having a first end connected with the tractor and a second end connected with the screed assembly. These screed assist device(s) are used to raise and lower the screed assembly with respect to the base surface, and can be operated so as to increase or decrease the compressive force exerted by the screed plates on the formed material mat by appropriate vertical displacement of the entire screed assembly (and thus also the screed plates).

Further, compactor vehicles or "compactors" are also well known. Typically, compactor vehicles used with asphalt material mats include a vehicle body and a pair of drum members or "drums" rotatably mounted to the body. Such compactor vehicles generally function by rolling over sections of the formed material mat such that the drums compact the formed material mat with every pass made over a particular section of the formed material mat, the drums also functioning to mobilize the compactor vehicles. Typically, a vibratory mechanism is mounted within each drum to increase the extent of formed material mat compaction made by each pass of the drums. These vibratory mechanisms are generally variable in frequency and amplitude, variations in frequency enabling the compactor to be effectively operated at different speeds and variations in amplitude affecting the degree of compaction made by the drums.

In a typical project for forming an asphalt mat, such as in roadway constructions, the paver vehicle forms a continuous mat of material behind the paver vehicle as the paver vehicle travels forwardly upon the base surface. One or more compactor vehicles follow the paver vehicle and generally roll over all sections of the formed material mat until the formed material mat is compacted to a desired degree or extent.

Preferably, the formed material mat is formed such that the material is within a desired temperature band. If sections of the formed material mat are at a lower than preferred temperature, compactor(s) may have to make additional passes across these sections to ensure sufficient compaction. On the other hand, if sections of the formed material mat are at a higher than preferred temperature, compactor operators will have to take caution to avoid over compacting these sections.

If would therefore be desirable to provide a system to monitor the temperature of the formed material mat as the formed material mat is being formed such that the temperature information may be used by an operator of a paver vehicle or a compactor vehicle to make appropriate adjustments to the operational parameters of the paver vehicle or compaction vehicle. Further, it would be desirable to provide a system for readily identifying sections of a formed material mat that may require additional compaction or sections of a formed material mat where it may be necessary to compact with greater caution. Furthermore, it would be desirable to provide a system for using formed sensed material mat temperature information to automatically adjust paver vehicle or compactor vehicle to provide an acceptable formed material mat.

BRIEF DESCRIPTION OF THE SEVERAL VIEWS OF THE DRAWINGS

The foregoing summary of the invention, as well as the detailed description of the preferred embodiments of the invention below, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
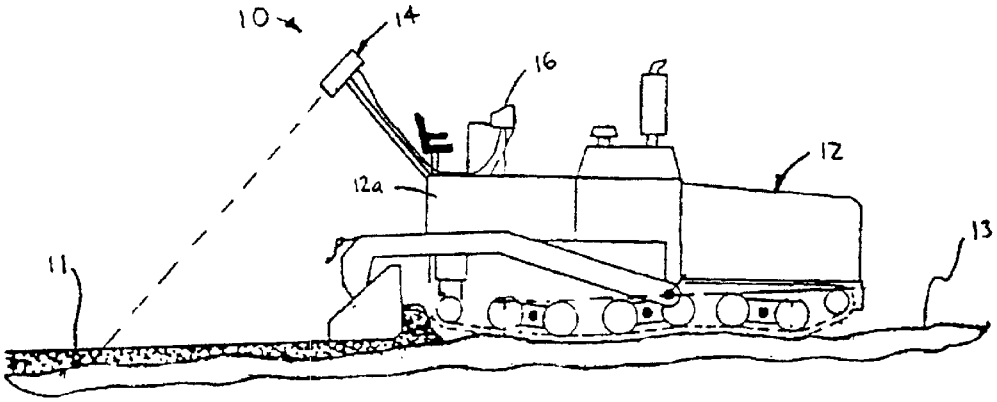
FIG. 1 is a diagrammatic side view of a temperature monitoring system for a paver vehicle in accordance with a preferred embodiment of the present invention.

Certain terminology is used in the following detailed description of the invention for convenience only and is not limiting. The words "right," left," "lower," "upper," "upward," "down," and "downward" designate directions in the drawings to which reference is made. The words "front" and "frontward," and "rear" and "rearward," refer to directions toward and away from, respectively, a designated travel direction of the paver vehicle or "paving" direction. The words "inner" and "inward," and "outer" and "outward," refer to directions toward and away from, respectively, the designated centerline of the paver vehicle. The terminology includes the words specifically mentioned above, derivatives thereof, and words of similar import.

I. Paver With Temperature Monitoring System

Referring now to the drawings, in which like-identified reference numbers a represent corresponding elements throughout the several views, attention is first directed to FIGS. 1 through-3, which show a presently preferred embodiment of temperature monitoring system 10 for paver vehicle 12 for forming formed material mat 11 of paving material upon base surface 13. Temperature monitoring system 10 preferably includes temperature sensor 14 connected with paver vehicle 12 and is capable of sensing the temperature of formed material mat 11 and generating an electrical signal representative of the sensed formed material mat temperature. Display device 16 is disposed on paver vehicle 12 and is electrically connected with temperature sensor 14. Display device 16 is capable of receiving the electrical signal sent by temperature sensor 12 and generating graphical image 17 corresponding to this electrical signal. Accordingly, graphical image 17 is representative of the sensed formed material mat temperature and, thus, the actual temperature of the formed material mat. Display device 16 is preferably disposed proximal to an operator station (not shown) on either the screed assembly and/or the tractor such that graphical image 17 provides a paver operator with information concerning the temperature of formed material mat 11. Using this formed material mat temperature information, the paver operator is able to make adjustments to the paver vehicle operation, as described below.

Figure 2:
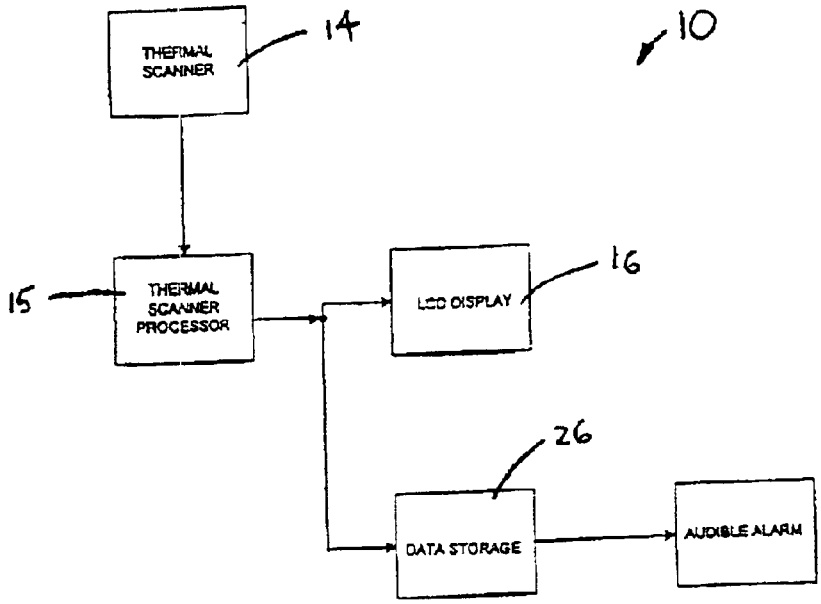
FIG. 2 is a flow-chart diagram of one preferred configuration of the temperature monitoring system.
Figure 3:
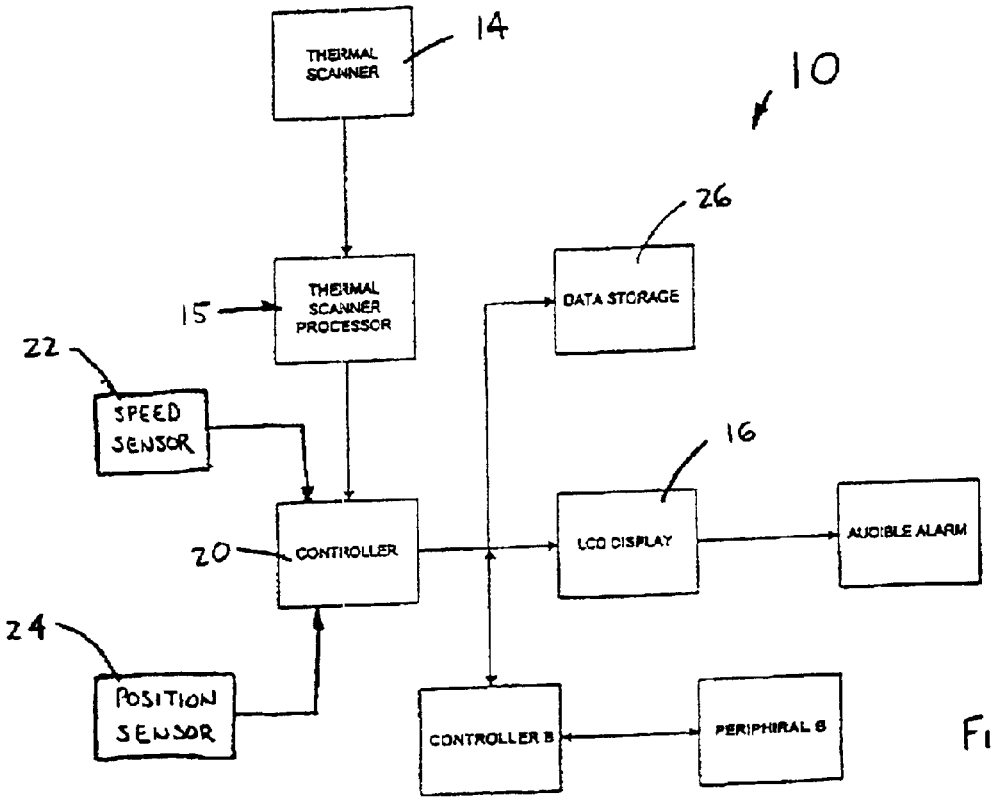
FIG. 3 is a flow-chart diagram of another preferred configuration of the temperature monitoring system.

As seen in FIGS. 1 through 3, temperature monitoring system 10 is used on paver vehicle 12 that is capable of forming formed material mat 11 behind paver vehicle 12 as paver vehicle 12 travels generally in a single direction (i.e., forwardly). Thus, formed material mat 11 is formed as a continuous strip having a width transverse to the direction of travel of paver vehicle 12. Temperature monitoring system 10 monitors the temperature of formed material mat 11 as it is being formed or laid by paver vehicle 12 and provides formed material mat temperature information to the paver operator by means of display device 16. Each of the above components of temperature monitoring system 10 is described in further detail below.

Temperature sensor 14 may be any appropriate type of thermal measuring or sensing device/system and is preferably a "non-contact" type of temperature sensor. In other words, the preferred temperature sensor 14 is capable of "remotely" sensing the temperature of formed material mat 11 without the need for any portion of temperature sensor 14 to make physical contact with formed material mat 11. However, temperature sensor 14 may, alternatively, be an appropriate "contact" type of temperature sensor, such as, for example, a thermocouple with a sensing junction (not shown). With such a "contact" type of temperature sensor 14, caution must be taken to ensure that temperature sensor 14 does not scratch or otherwise damage formed material mat 11 or become itself damaged by contact with formed material mat 11.

Most preferably, temperature sensor 14 is either a thermal imager, a thermal scanner, or a thermal imager operating in "line-scan" mode. Temperature sensor 14 is preferably mounted at rear end 12*a* of paver vehicle 2 at a height sufficiently above formed material mat 11 so as to be capable of viewing, and thus imaging, or scanning across substantially the entire width of formed material mat 11.

As thermal imagers and thermal scanners are well known in the temperature sensing and thermal imaging arts, a detailed description of these types of temperature sensors is beyond the scope of the present disclosure, although certain features are now described. A thermal imager generally includes one or more temperature detectors and/or sensors, such as, for example, a video camera with an infrared filter or an infrared "vidicon" tube, with the temperature detector and/or sensor receiving heat or infra-red energy from a target object and/or surface, such as formed material mat 11, and generating electrical signals corresponding to the thermal image of the object/surface. A thermal scanner also includes one or more temperature detectors and/or sensors, but further includes optical elements (e.g., one or more mirrors) to present the one or more temperature detectors and/or sensors with infra-red energy from a plurality of locations on the target object and/or surface, such as formed material mat 11 to construct a thermal image of the target object and/or surface.

When temperature sensor 14 is a thermal scanner, the thermal scanner is capable of sensing the formed material mat temperature at a plurality of locations on formed material mat 11 and generating i plurality of electrical signals corresponding to the sensed formed material mat temperature at a plurality of locations on formed material mat 11. The electrical signals generated by the thermal scanner, which are representative of the sensed formed material mat temperature at each of the plurality of locations on formed material mat 11, are transmitted to display device 16 by appropriate means (e.g., wires, cables, etc). Preferably, the thermal scanner is capable of repeatedly scanning across at least a portion of the width of formed material mat 11 so as to periodically sense the formed material mat temperature at successive sections of formed material mat 11 along or with respect to the direction of travel of paver vehicle 12. Thus, each side-to-side pass of the thermal scanner across the width of formed material mat 11 provides temperature measurements for a strip-like section of formed material mat 11 and the series of repeated passes and scans provide temperature information on each successive strip of formed material mat 11 as paver vehicle 12 continues to travel and form formed material mat 11.

In addition, display device 16 is capable of receiving the plurality of electrical signals from the thermal scanner and generating and displaying graphical image 17 representative of the sensed formed material mat temperature profile of a section of formed material mat 11 corresponding to the plurality of electrical signals received from the thermal scanner. Thus, this section of formed material mat 11 includes a plurality of locations on formed material mat 11 the thermal scanner has sensed or measured the formed material mat temperature. Display device 16 is preferably capable of periodically updating graphical image 17 so as to represent the formed material mat temperature at successive sections on formed material mat 11 as paver vehicle 12 continues to travel. More specifically, graphical image 17 is preferably updated with sensed formed material mat temperature information from each successive pass of the thermal scanner across with of formed material mat 11 such that graphical image 17 "scrolls" on display device 16 as paver vehicle 12 travels and formed material mat 11 is being formed.

At the present, a preferred thermal imager is the ThermoVision™ thermal imager product and a preferred thermal scanner is the ThermoProfile™ thermal scanner product, each of these products being commercially available and manufactured by FLIR Systems Inc. of Portland, Oreg. However, any other type, brand or specific product of thermal imager or scanner may, alternatively; be used, such as, for example, a Thermoprofile® 6 line thermal scanner commercially available from AGEMA Infrared Systems Ltd. of Burlington, Ontario Canada.

Display device 16 is preferably either a cathode ray tube (CRT) type display device or a liquid crystal display (LCD) display device, each of these types of display devices being well known such that a detailed description thereof is beyond the scope of the present disclosure. With a cathode ray tube (CRT) type display device, graphical image 17 represents a "real-time" thermal profile of the formed material mat 11. Such a "Seal-time" graphical image 17 is generated by using an appropriate software program or other techniques for converting the sensed formed material mat temperature data sensed by temperature sensor 14 into a viewable format, as is well known in the thermal imaging and scanning art.

Referring to FIG. 3, with a liquid crystal display (LCD) type display device, the electrical signal output of temperature sensor 14 is passed through thermal scanner interface device 15, such as an A/D converter, so digital signals representative of the scanned formed material mat temperature are sent to the liquid crystal display (LCD) type display device. A portion of the output from scanner interface device 15 may be transmitted to controller 20 having programmable memory for storing sensed formed material mat temperature data and/or for executing control programs to produce output control signals used to operate various paver vehicle operations, as discussed below.

Graphical image 17, such as that depicted in FIG. 2, identifies and displays thermal gradients existing across formed material mat 11. Significant thermal gradients affect the quality of formed material mat 11. In particular, colder spots of formed material mat 11 are more difficult to compact than hotter spots and, if not compacted correctly, ray cause premature damage to occur to formed material mat 11. Thus, temperature monitoring system 10 uses the sensed formed material mat information about thermal gradients existing in a newly laid formed material mat 11 to control and improve the quality of paving operations.

Referring to FIG. 2, various graphical images 17 may be generated by as temperature monitoring system 10 and displayed on display device 16. Graphical images 17 shown in FIG. 2 depict various manners of representing the thermal profile of a typical freshly-laid formed material mat 11. The particular display information depicted in FIG. 2 also includes actual temperature profiles, 18A and 18B, taken along two lines, LI01 and LI02, across formed material mat 11. The sensed formed material mat temperature data may additionally, or alternatively, be presented in the form of data table 19 and may include maximum, minimum and average temperatures along lines LI01 and LI02 at a particular area AR01 or at a particular point SP01. Display device 16 used in a particular application may include less or additional sensed formed material mat temperature data, and/or present the sensed formed material mat temperature data in different formats (e.g., an liquid crystal display (LCD) type display with a numerical read-out of the sensed formed material mat temperature), than the exemplary display information shown in FIG. 2.

Referring to FIG. 3, temperature monitoring system 10 is configured such that the thermal scanner only records and displays the formed material mat thermal information when paver vehicle 12 is in motion. In addition, the forward speed of paver vehicle 12 may be simultaneously recorded and processed to allow the position of paver vehicle 12 relative to base surface 13 to be determined and the formed material mat thermal profiles cross-referenced or correlated to specific locations on the road (i.e., formed material mat 11). Temperature monitoring system 10 preferably further includes a motion and/or speed sensor 22 and/or position sensor 24, each of motion and/or speed sensor 22 and/or position sensor 24 being disposed on paver vehicle 12. Motion and/or speed sensor 22 is preferably provided when temperature sensor 14 is a thermal scanner and is capable of sending electrical signals to the thermal scanner so the thermal scanner pauses when paver vehicle 12 is idle or has stopped moving and thermal scanner scans only when paver vehicle 12 is moving to avoid re-scanning areas of formed material mat 11 that have already been displayed on display device 16.

Position sensor 24 is capable of sensing the position of paver vehicle 12 with respect to base surface 13, and thus provides an indication of the locations on formed material mat 11 that are being viewed or scanned by temperature sensor 14. Position sensor 24 may be any appropriate position sensing device, such as for example, a global positioning system (G.P.S.) system or a laser-based position sensing system, each of these types of position sensing systems being known in the paving art.

Position sensor 24 is preferably used with temperature monitoring system 10 that includes controller 20, as shown in FIG. 3. Controller 20 includes a resident software program capable of correlating the sensed paver vehicle positions with the sensed formed material mat temperatures to provide information as to the sensed formed material mat temperature at each position on formed material mat 11 that is scanned or viewed. Further, controller 20 preferably includes a database software program or is connected to a separate database system (not shown). The database software program or system is capable of storing the correlated sensed paver vehicle position information and the sensed formed material mat temperature-information so the correlated information may be stored, and later analyzed and/or reproduced, for the entire length of formed material mat 11 paved by the paver vehicle 12. This correlated sensed paver vehicle position information and the sensed formed material mat temperature-information may be used for monitoring wear of formed material mat 11 and to provide quality assurance information. The sensed paver vehicle position data output from position sensor 24 and the sensed formed material mat temperature data output from the thermal scanner are preferably recorded onto high capacity discs or cards (not shown) and are preferably maintained as a historical record of the thermal profile of a roadway (i.e., formed material mat 11) as laid.

II. Marking of a Newly Laid Formed Material Mat Using a Thermal Scanner

Figure 5:
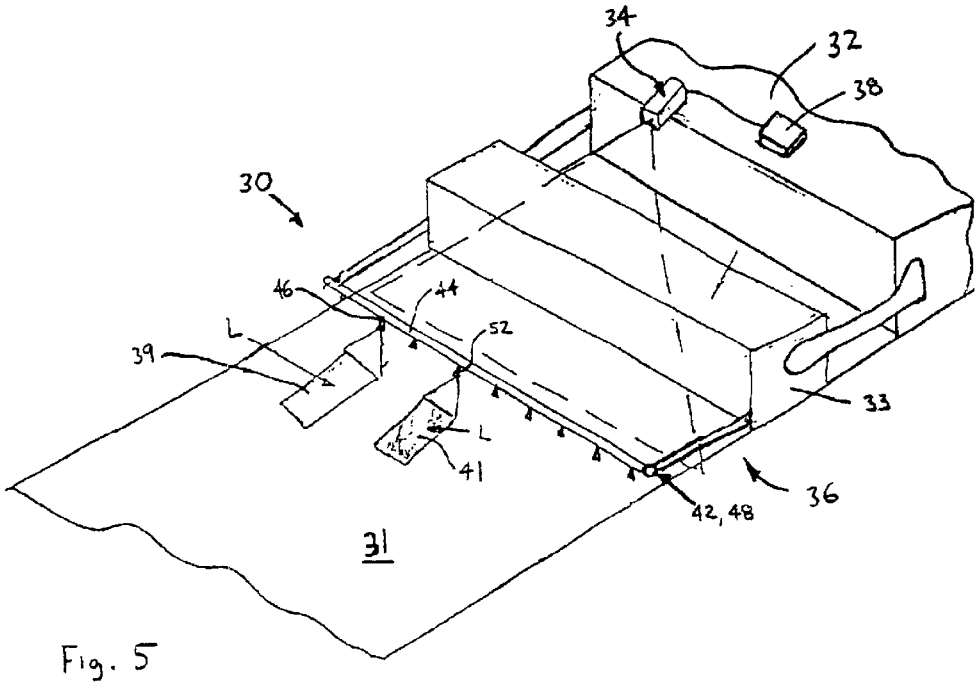
FIG. 5 is a diagrammatic rear perspective view of a marking system in accordance with the present invention.
Figure 4:
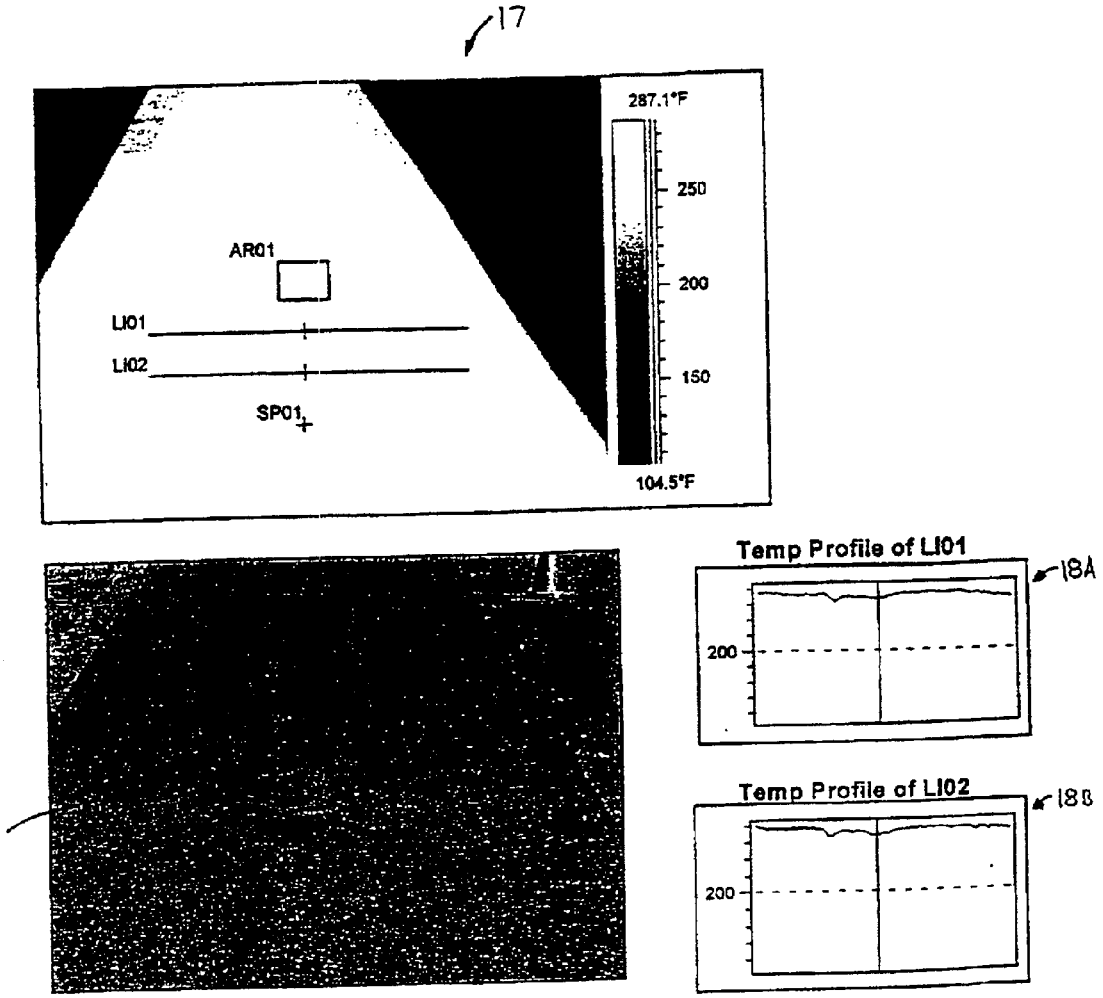
FIG. 4 is a view of a thermal image and exemplary displays generated by the temperature monitoring system.
Figure 6:
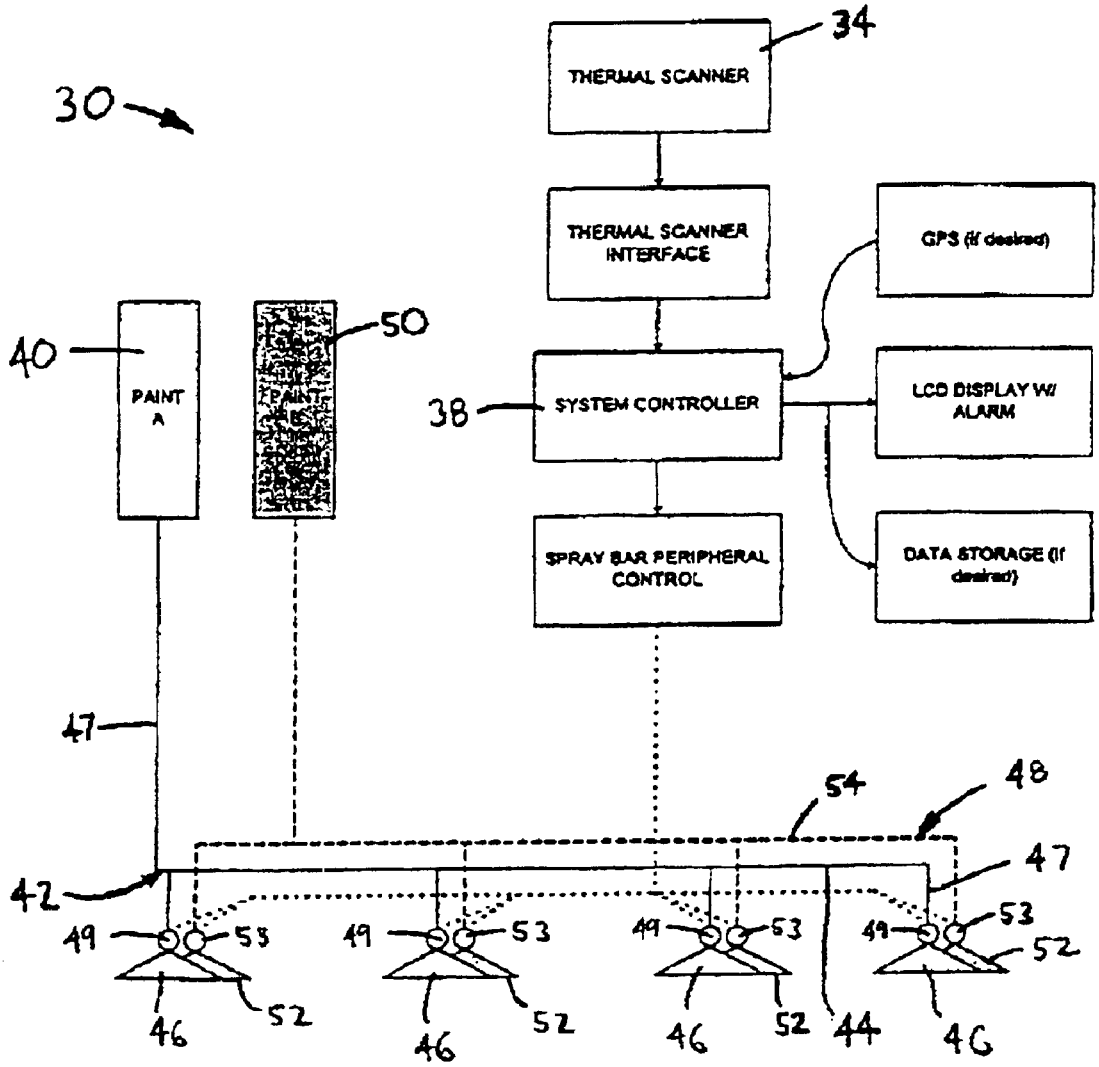
FIG. 6 is a flow-chart diagram of the marking system.
Figure 8:
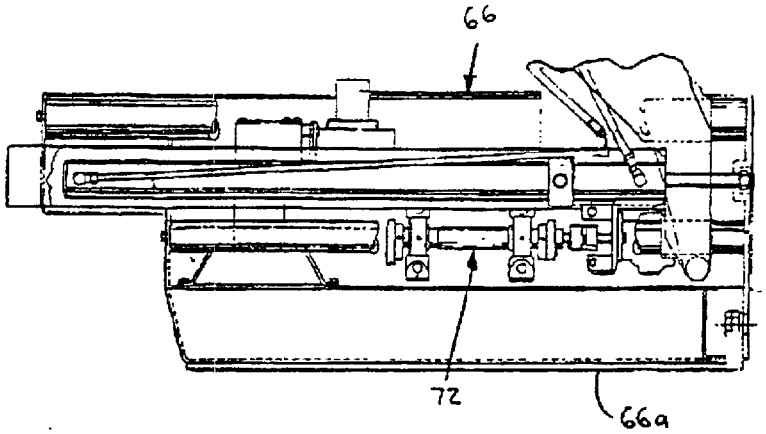
FIG. 8 is a broken-away front elevational view of a screed extension having a vibrator device.
Figure 12:
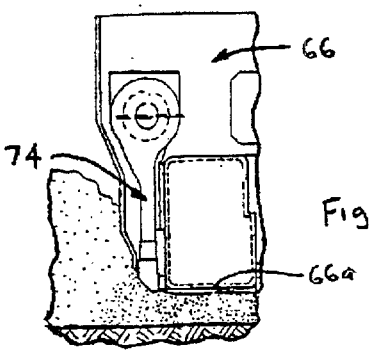
FIG. 12 is a broken-away side elevational view of a screed assembly having a tamper bar device.
Figure 7:
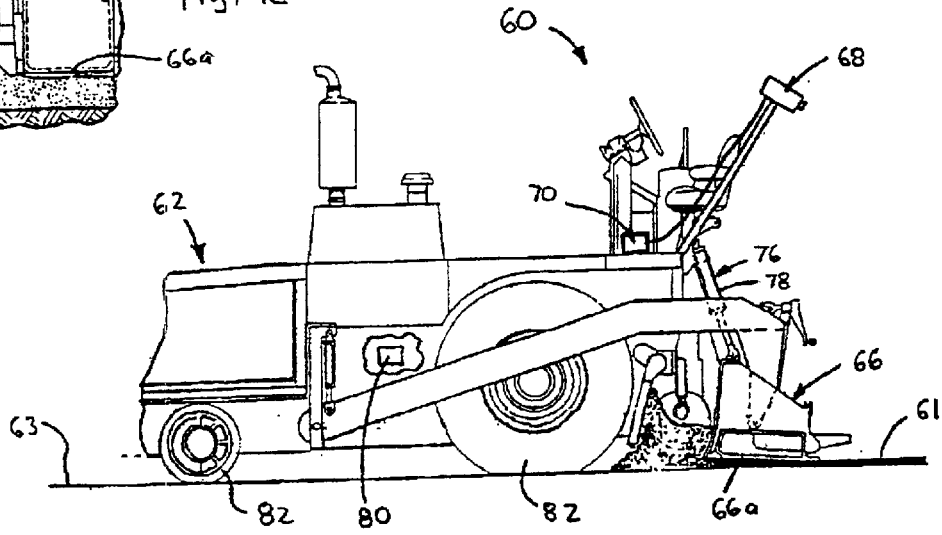
FIG. 7 is a side elevational view of a paver vehicle having a paver vehicle control system in accordance with the present invention.
Figure 9:
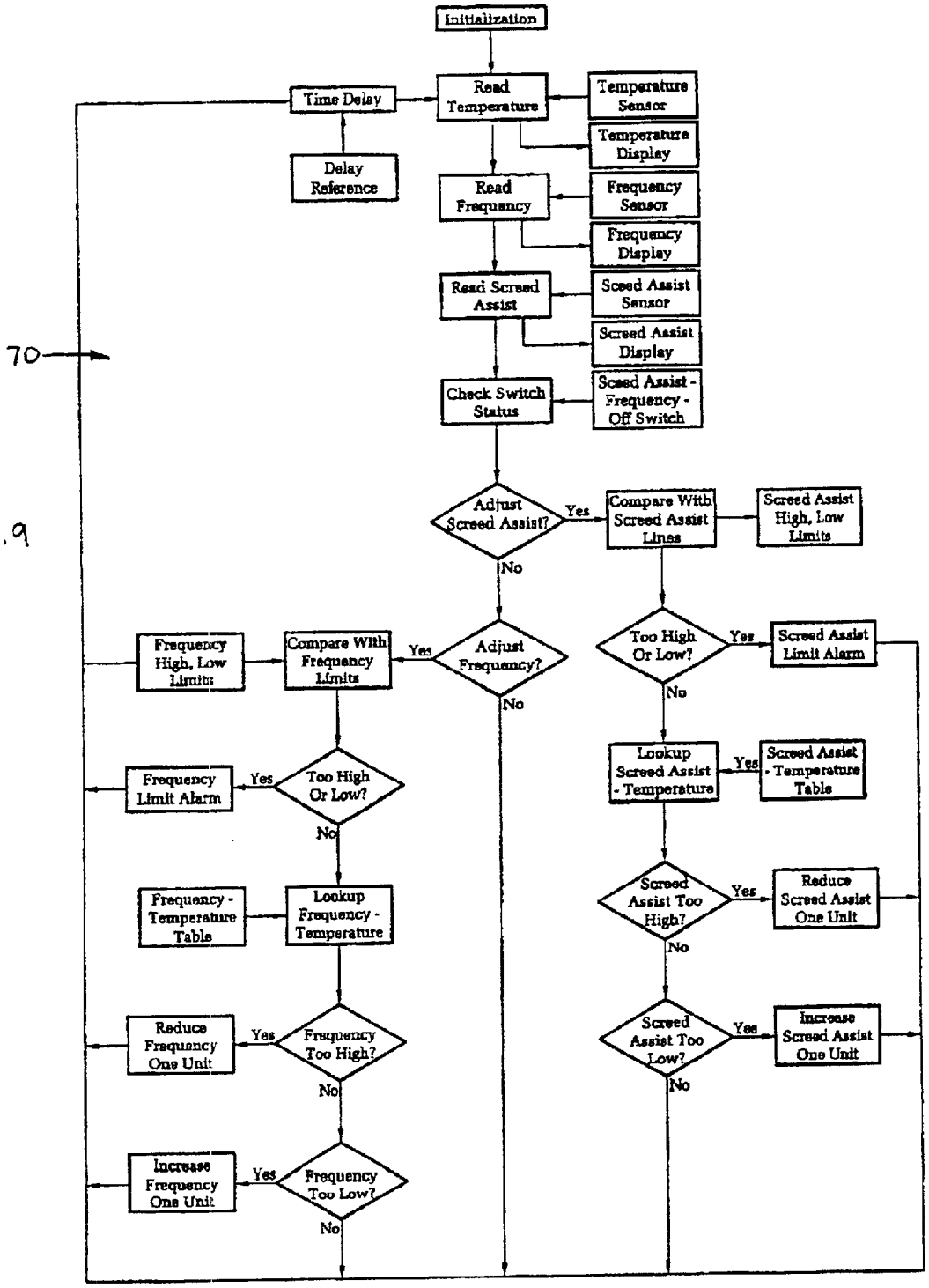
FIG. 9 is a flow-chart diagram of a preferred control method for controlling a vibrator and screed assist device.
Figure 10:
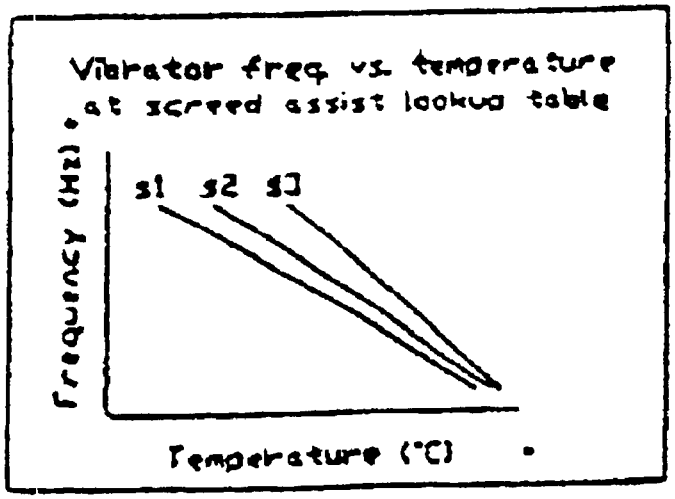
FIG. 10 is a graph diagram depicting a predetermined relationship between vibrator frequency and sensed formed material mat temperature.
Figure 11:
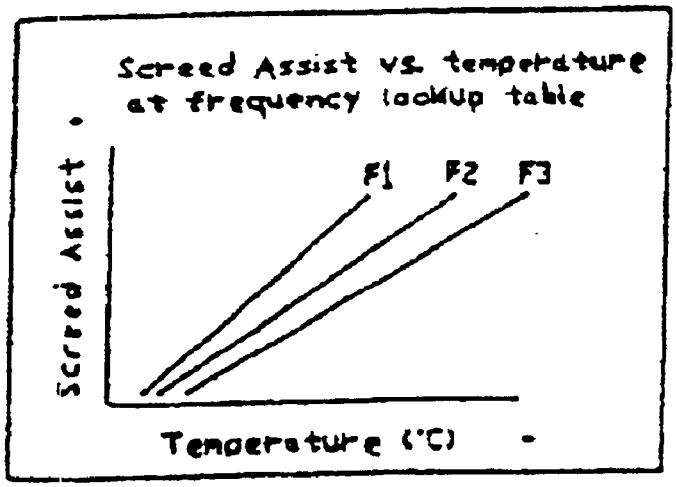
FIG. 11 is a graph diagram illustrating a predetermined relationship between screed assist device pressure and sensed formed material mat temperature.
Figure 13:
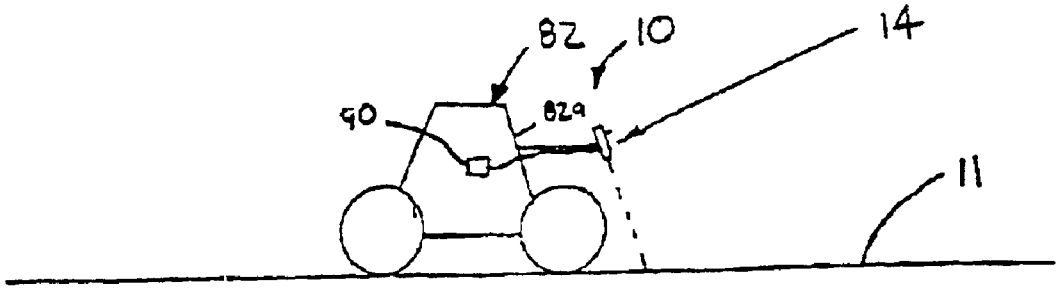
FIG. 13 is a diagrammatic side plan view of a compactor having the temperature monitoring system.
Figure 14:
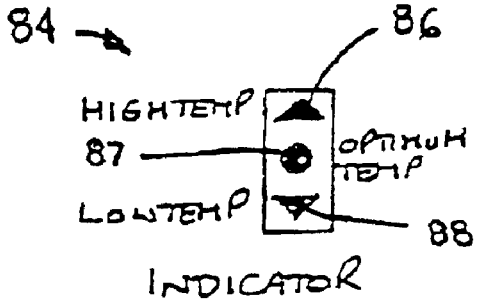
FIG. 14 is a plan view of an indicator for the system shown in FIG. 13.
Figure 15:
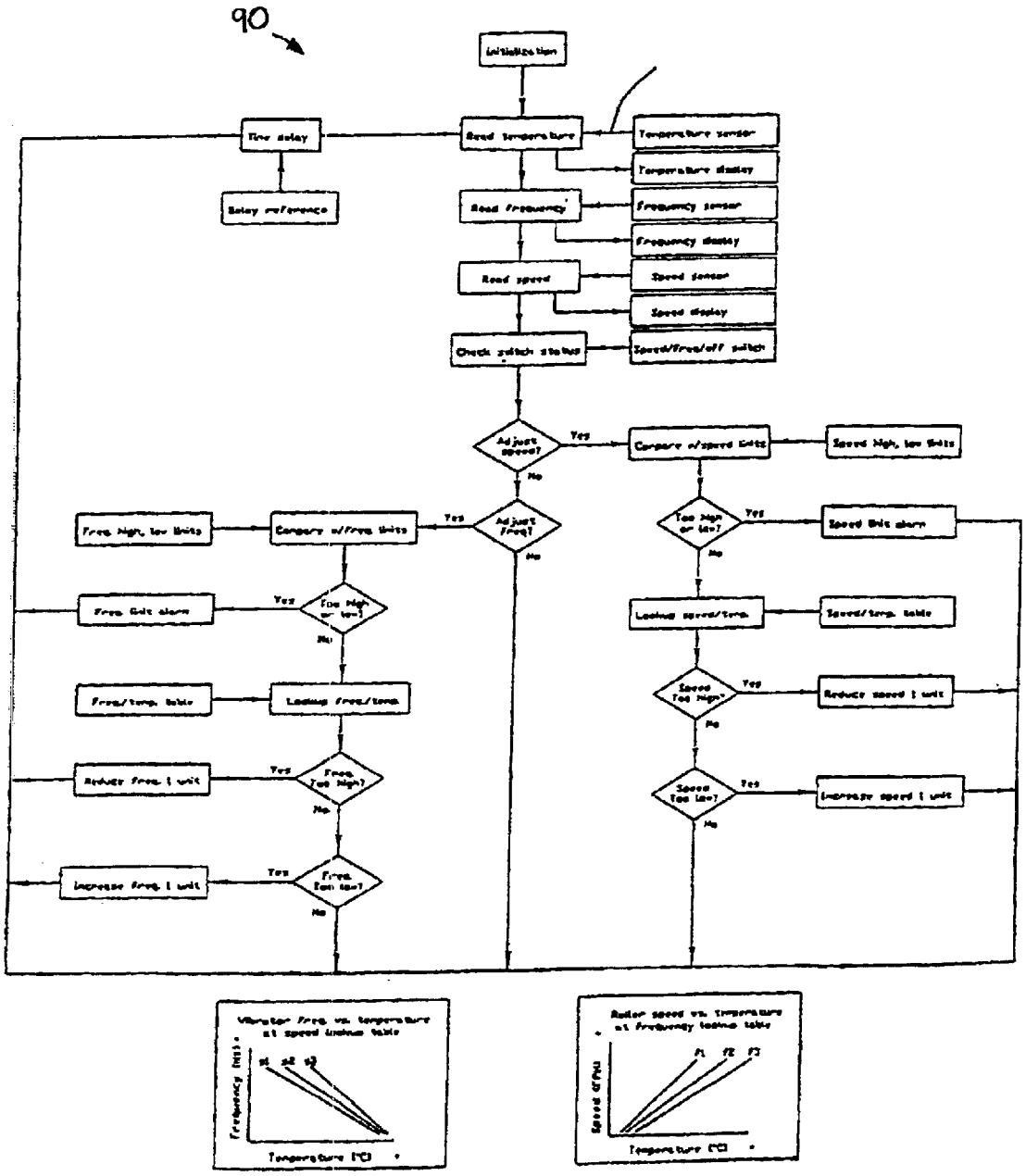
FIG. 15 is a flow chart diagram of a compactor control system using the temperature monitoring system.
Figure 16:
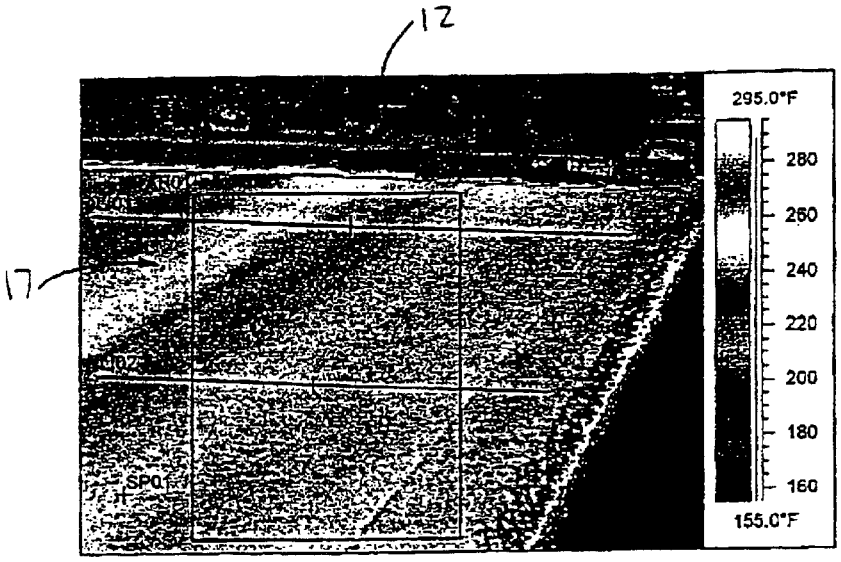
FIG. 16 is a view of a thermal image and exemplary display graphics as may be generated by a monitoring system mounted on a compactor.
Figure 16:
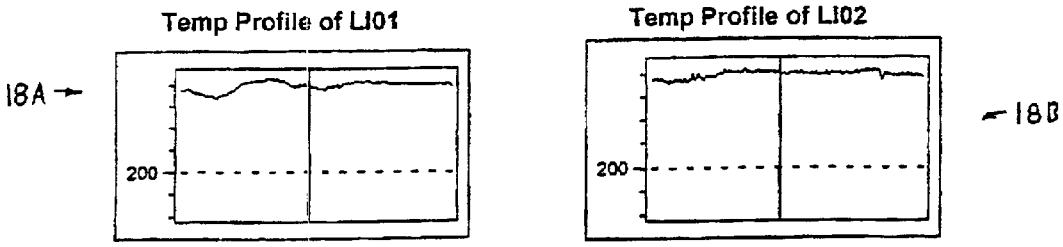

Referring now to FIGS. 4 and 5, a presently preferred embodiment of marking system 30 for paver vehicle 32 capable of forming a mat of paving material upon a base system is shown. Marking system 30 generally includes temperature sensor 34 connected with paver vehicle 32, temperature sensor 34 being capable of sensing the formed material mat temperature, such as at location L, on formed material mat 31. Marking device 36 is mounted to paver vehicle 32 and is capable of forming a visible mark on formed material mat 31. Controller 38 is disposed on paver vehicle 32 and is electrically connected with temperature sensor 34. Controller 38 is capable of operating marking device 36 such that marking device 36 forms a visible mark a predetermined locations on formed material mat 31, such as at location L, when the sensed formed material mat temperature is either above a first selected temperature value or below a second selected temperature value. First selected temperature value and second selected temperature value could be the same temperature, if desired, but are preferably different temperature values which represent the extremes of the range of temperature values which would result in an "acceptable" formed material mat 31.

Marker device 36 is preferably capable of forming both first mark 39, as well as a visually distinguishable second mark 41. With such a marker device 36, controller 38 is preferably capable of operating marker device 36 such that marker device 36 forms first mark 39 on formed material mat 31 when the sensed formed material mat temperature is below the first selected temperature value and marker device 36 forms second mark 41 on formed material mat 31 when the sensed formed material mat temperature is above the second selected temperature value. As discussed, above, the first selected temperature value and the second selected temperature value preferably represent the lower limit and the upper limit, respectively, of a range or band of formed material mat temperatures that are determined to be acceptable for normal paving and compaction operations.

Thus, locations L on formed material mat 31 identified with first mark 39 have been sensed as having a higher than desired temperature for normal paving and compaction, such that paving and compaction should be performed relatively slower and with less vibration amplitude to prevent excessive compaction of formed material mat 31. Further, locations L on formed material mat 31 identified with second mark 41 have been sensed as having a lower than desired temperature for paving and compaction, such that paving and compaction should be performed more rapidly and with greater vibration amplitude to ensure that sufficient compaction of formed material mat 31 is achieved.

Temperature sensor 34 is preferably a "non-contact" type temperature sensor, and most preferably is a thermal imager or thermal scanner as described above. Alternatively, temperature sensor 34 may be any other type of "non-contact" sensor or even a "contact" sensor, although the same concerns as discussed above must be addressed when using a "contact" type temperature sensor in this application.

When temperature sensor 34 is a thermal scanner, the thermal scanner is preferably capable of sensing the formed material mat temperature at a plurality of locations L on formed material mat 31. With such a temperature sensor 34, controller 38 is preferably capable of operating marking device 36 such that marking device 36 forms first mark 39 or second mark 41 at each location L where the sensed temperature is either below the first selected temperature value (first mark 39) or above the second selected temperature value (second mark 41).

Still referring to FIGS. 4 and 5, marker device 36 is preferably a "sprayer" type of marker system capable of applying an appropriate chemical (e.g., paint, ink, etc.) on formed material mat 31 to form readily observable or visible first mark 39 or second mark 41 on formed material the mat 11. Marker device 36 preferably includes a supply 40 of a marking chemical, most preferably paint, and sprayer device 42 connected with marking chemical supply 40 that is capable of directing a quantity of the marking chemical onto formed material mat 31 at least proximal to locations on formed material mat 31 where first mark 39 or second mark 41 is desired. Sprayer device 42 preferably includes spray bar 44, a plurality of delivery nozzles 46 spaced along spray bar 44, a plurality of valves 49 each controlling flow through a separate one of delivery nozzles 46 and hoses or pipes 47 to connect the various components of spraying device 42.

Spray bar 44 may either be a hollow tube, such that the marking chemical flows through the hollow tube to each delivery nozzle 46, or a solid bar used solely for mounting the delivery nozzles 46, with hoses or pipes 47 extending to each individual delivery nozzle 46. Spray bar 44 is mounted to the rear end of paver vehicle 32, preferably to a rear portion of paver screed assembly 33. Further, delivery nozzles 46 are arranged on spray bar 44 so as to be spaced across at least a portion of the width of the formed material mat 31.

Marker device 36 preferably includes second sprayer device 48 having a second marking chemical supply 50, a second set of delivery nozzles 52 and a corresponding plurality of valves 53, and second sprayer bar 54, as shown in FIG. 5, if spray bar 44 is used to channel the first marking chemical and not merely to mount delivery nozzles 46. Second marking chemical supply 50 preferably contains a marking chemical that is visibly distinguishable from the marking chemical in spraying device 42, each marking chemical preferably having a different color. Second set of delivery nozzles 52 are preferably each disposed proximal to delivery nozzles 46.

With two sprayer devices 36 and 48, one sprayer device (e.g. sprayer 42) is preferably used to form first marks 39 at locations on formed material mat 11 where the sensed formed material mat temperature is below the first selected temperature value. The other sprayer device (i.e., sprayer 48) is preferably used to form second marks 41 at locations on formed material mat 31 where the sensed formed material mat temperature is above the second selected temperature value. Valves 49 and 53 controlling flow through delivery nozzles 46 and 52, respectively, are preferably electromechanically actuated to facilitate controlling marker device 36, as discussed above and in further detail below.

Although the above-described configuration is preferred, marker device 36 may be constructed as any other system capable of creating first mark 39 and/or second mark 41 on the formed material mat 31. For example, marker device 36 may have one or a pair of delivery nozzles slidably mounted on a rail (not shown) so as to be adjustably positionable with respect to the width of the formed material mat 31. Further, for example, marker device 36 may be constructed as one or a pair of nozzles mounted on a rotatable base and configured to direct flow in various directions by controlled rotation of the base (not shown). As yet another example, marker device 36 may include ore or more movable brushes or another such direct contact type of applicator (none shown). The present invention includes these or any other appropriate constructions of marker device 36 capable of functioning generally as described herein.

Referring to FIG. 5, controller 38 preferably includes a resident software program or other computing means, such as hard-wired logic circuits, that is capable of comparing electrical signals received from temperature sensor 34 with the first selected temperature value and the second selected temperature value and generating control signals to open or close each of valves 49 in first sprayer device 42 and/or to open or close each of valves 53 in second sprayer device 48 as required. Further, controller 38 is preferably configured to "divide" formed material mat 31 into an appropriate number of zones across the imaging or scanning width of temperature sensor 34, each such zone being associated with one of delivery nozzles 46 and one of delivery nozzles 52 (if both sprayer devices are present). Controller 38 preferably includes programmable memory such that the paver vehicle operator may enter a different first selected temperature value and/or a different second selected temperature value for a particular paving jobs, which vary depending on factors such as type of paving material, the ambient temperature, etc.

In use, the preferred marker system 30 marks the relatively "hotter" areas of formed material mat 31 with first mark 39 to indicate that these areas should be allowed to cool before rolling and/or compacting, rolled at a faster speed, and/or rolled at a lower vibration frequency. On the other hand, marker system 30 marks relatively "colder" areas of the formed material mat 31 with second mark 41 so as to indicate the need for immediate remedial work and/or to indicate where the compactor vehicle(s) should be driven at a lower speed over the area and/or operate at higher vibration frequencies. As discussed above, first mark 39 and second mark 41, respectively, are preferably differentiated by color (e.g., first mark—red, second mark—blue), although the first mark 39 and second mark 41 may have different shapes or be otherwise visually distinguishable.

III. Thermal Scanning for Automatic Control of Paver Vehicles

Referring now to FIGS. 6 through 12, presently preferred embodiment of paver vehicle control system 60 for paver vehicle 62 for forming a formed material mat 61 of paving material upon base surface 63 is shown. Paver vehicle 62 generally includes tractor 64 that is capable of being operated at various travel speeds with respect to base surface 63 and screed assembly 66 connected with tractor 64. Screed assembly 66 forms paving material deposited off of tractor 64 into formed material mat 61, the travel speed of tractor 64 determining the speed formation of formed material mat 61.

Paver vehicle control system 60 generally includes temperature sensor 68 connected with paver vehicle 62, temperature sensor 68 being capable of sensing the temperature of formed material mat 63. Paver vehicle control system 60 includes one or more devices for varying the compressive force exerted by screed assembly 66 on the paving material during formation of formed material mat 61, as discussed below. Controller 70 is disposed -on paver vehicle 62 and is electrically connected with temperature sensor 68. Controller 70 is capable of operating the one or more of the compressive force varying devices in accordance with a predetermined relationship between the sensed formed material mat temperature and the compressive force exerted by screed assembly 66. Alternatively, or in addition, paver vehicle control system 60 may include one or more devices for varying the travel speed of tractor 64, as discussed below. Controller 70 is also preferably capable of adjusting the travel speed varying device(s) in accordance with a predetermined relationship between the sensed formed material mat temperature and the travel speed of tractor 64, as discussed below.

Temperature sensor 68 is preferably a "non-contact" type temperature sensor, and most preferably a thermal imager or a thermal scanner as described in detail in Section I above. The electrical signal output of the temperature sensor 68 is preferably passed through scanner interface device 69, such as an A/D converter, so digital signals representative of the sensed formed material mat temperature are sent to controller 70. As discussed below, controller 70 preferably includes a resident software program, or alternatively a hard-wired logic circuit, that is capable of comparing input sensed formed material mat temperature data with stored data containing the predetermined relationships to generate output control signals based on these comparisons. These output control signals are used to operate various devices on paver vehicle 62, as discussed below.

Screed assembly 66 and tractor 64 preferably include one or more of the following devices/mechanisms that affect the amount or magnitude of compressive force exerted by the screed plate 66*a* on paving material and are each conventionally provided on commercially available paver vehicles. As a general rule, controller 70 increases the compressive force exerted by screed assembly 66 and/or increases the travel speed of tractor 64 when the sensed formed material mat temperature is below a first selected temperature value and decreases the compressive force exerted by screed assembly 66 and/or decreases the travel speed of tractor 64 the sensed formed material mat temperature is above a second selected temperature value. Thus, the first selected temperature value and the second selected temperature value represent the lower and upper limits of an acceptable range of temperature values, or a temperature band, for forming formed material mat 61. Portions of formed material mat 61 having a sensed formed material mat temperature within the acceptable range of temperature values indicate that paver vehicle 60 is performing satisfactorily and enables optimal compaction during subsequent rolling operations.

Vibration device 72 is preferably mounted on the upper surface of each screed plate 66*a* and is capable of being operated at various frequencies by appropriate adjustment of a hydraulic motor that rotates a weighted shaft. Vibrator devices are well known in the paving art, such that a detailed description thereof is not required for a clear understanding of the present invention.

However, vibrator device 72 may be constructed to have an automatically adjustable amplitude. Such automatic adjustment of the vibrator amplitude may be provided by any appropriate means, such as by providing a linear actuator or servomotor (neither shown) configured to displace the weights with respect to the shaft to vary the radial distance from the centerline of the shaft. Thus, vibrator amplitude is increased or decreased by respectively increasing or decreasing the radial distance of the weights from the shaft centerline. Further, the preferred vibrator device 72 includes controllable means to adjust the vibrator frequency, such as an electro-mechanical valve (not depicted) controlling flow to the motor (not shown).

Vibrator device 72 is adjusted in the following predetermined relationship between sensed formed material mat temperature and compressive force exerted by screed assembly 66. In particular, controller 70 increases the vibration frequency when the sensed formed material mat temperature is below a first selected temperature value and decreases the vibration frequency when the sensed formed material mat temperature is above a second selected temperature value. The first selected temperature valve and the second selected temperature value represent the lower and upper limits, respectively, of a band of "acceptable" sensed formed material mat temperature values a particular paving project.

A control algorithm includes steps for controlling the adjustment of the vibration frequency of screed assembly 66 in the desired manner, this control algorithm being programmed or hard-wired into controller 70. Alternatively, controller 70 may periodically adjust the vibration frequency of screed assembly 66 in accordance with a predetermined optimal frequency for each temperature value of the sensed formed material mat temperature, although such a control system is more complex to both construct and operate.

The vibration frequency exerted by screed assembly affects the compressive stress exerted by screed assembly 66 on the paving material during leveling by increasing or decreasing the number of "downward pushes" applied to screed plate 66*a* during predetermined interval of time by the rotating eccentric weights. Thus, more vibrations or "downward pushes against screed plate 66*a* are desired when the sensed formed material mat temperature is "colder" (and thus more difficult to compact) to obtain the desired end result and less vibrations or "downward pushes" are desired when the sensed formed material mat temperature is "hotter" (and thus easier to compact) to preclude "over-compaction" and obtain the desired end result.

Further, with vibrator device 72 having adjustable amplitude, controller 70 is preferably capable of increasing the amplitude of vibrator device 72 when the sensed formed material mat temperature is below the first selected temperature value and decreasing the amplitude of vibrator device 72 when the sensed formed material mat temperature is above the second selected temperature value. Controller 70 may, alternatively, be configured to periodically adjust the vibrator amplitude in accordance with a predetermined "optical" vibrator amplitude for each value of sensed formed material mat temperature. Vibrator amplitude affects the compressive force exerted by screed assembly 66 by increasing or decreasing the magnitude of the downward push" applied to screed plate 66*a* by vibrator device 72. Thus, stronger vibrations/pushes against screed plate 66*a* are desired when the sensed formed material mat temperature is "colder" (and thus more difficult to compact) to obtain a desired end result and relatively weaker vibrations are desired when the sensed formed material mat temperature is "hotter" (and thus easier to compact) to preclude "over-compacting" and obtain the desired end result.

Paver vehicle 62 preferably includes screed-assist device 76 having hydraulic cylinder 78 extending between tractor 64 and screed assembly 66. Such screed assist devices 76 are also well known in the paving art, such that a detailed description thereof is beyond the scope of the present disclosure. Screed-assist device 76 vertically displaces screed assembly 66, and thus also screed plate 66*a*, by appropriate extension and retraction of hydraulic cylinder 78. Screed assist device 76 is used for both "gross" lifting of screed assembly 66, such as when traveling between paving job-sites, and also for varying the pressure of screed plate 66*a* on formed material mat 61 during paving, as described below.

Screed-assist device 76 is adjusted in the following predetermined relationship between sensed formed material mat temperature and the compressive stress exerted by screed assembly 66. Controller 70 extends hydraulic cylinder 78 when the sensed formed material mat temperature is below a first selected temperature value and retracts hydraulic cylinder 78 when the sensed formed material temperature is above a second selected temperature value. The first selected temperature value and the second selected temperature value are the lower limit and the upper limit, respectively, of a desired band of "acceptable" temperature values for formation of formed material mat 61, which are preferably the same temperature band values as that used for controlling vibrator device 72.

By retracting the hydraulic cylinder 78, screed plate 66*a* is lifted upwardly relative to the paving material being formed, which decreases the compressive force exerted on the paving material by screed assembly 66 and, thus, the extent or amount of material compaction performed by screed assembly 66. On the other hand, extending hydraulic cylinder 79 moves screed assembly 66 toward base surface 63, thereby increasing the compressive force exerted by screed assembly 66 and the amount of material compaction performed by screed assembly 66.

Although the extension and retraction of hydraulic cylinder 78, and, thus, the relative displacement of screed plate 66*a* are used to adjust the compressive force exerted by screed assembly 66, controller 72 actually monitors and adjusts the hydraulic pressure in hydraulic cylinder 78. The relatively small amount of movement of the hydraulic cylinder rod involved in adjusting the screed assembly 66 pressure makes pressure monitoring and adjustment of hydraulic cylinder 78 easier to implement and control than attempting to directly control the position of the hydraulic cylinder rod.

Screed assembly 66 may include tamper bar device 74 mounted forwardly of screed plate 66*a* (i.e., between screed assembly 66 and tractor 64) that is capable of operating at various frequencies and amplitudes. Tamper bar devices are well known in the paving art and are commonly used in European paving operations, such that a detailed description thereof is not required for a clear understanding of the present invention.

With screed assembly 66 including tamper bar device 74, controller 70 increases the frequency and/or amplitude of tamper bar device 74 when the sensed formed material mat temperature is below a first selected temperature value and decreases the frequency and/or amplitude of tamper bar device 74 when the sensed formed material mat temperature is above a second selected temperature value. As with vibrator device 72 and screed-assist device 76, the first selected temperature value and the second selected temperature value correspond to the lower limit and the upper limit, respectively, of an "acceptable" band of sensed formed material mat temperature values, and are preferably the same temperature band values as used for controlling vibrator device 72 and screed assist device 76.

Controller 70 also preferably automatically adjusts a speed varying device, such as a throttle or speed selector device 80, in accordance with a predetermined relationship between the sensed formed material mat temperature and the travel speed of tractor 64. As is conventional, tractor 64 includes a plurality of wheels 82 that act to mobilize tractor 64 relative to base surface 63. The plurality of wheels 82 can either operate separately or as part of a wheel train to drive a continuous track. A hydraulic motor (not shown) is preferably used to drive wheels 82. Throttle or speed selector device 80 controls the travel speed of paver vehicle 62, either by controlling the speed of the motor or by varying the gear ratios on the drive train components (not depicted) operating between the motor and the shafts of wheels 82 (neither depicted).

Controller 70 adjusts throttle or speed selector device 80 to adjust the travel speed of tractor 64 and, therefore, the speed of formation of formed material mat 61 or the "paving speed" in the following manner. If temperature sensor 68 indicates that the sensed formed material mat temperature is below a first selected value, and is thus "colder" than desired, controller 70 adjusts throttle or speed selector-device 80 to increase the travel speed of tractor 64. At a greater travel speed for tractor 64, paver vehicle 60 exerts a greater pull on screed assembly 66 such that screed assembly 66 tends to compress formed material mat 61 to a greater extent. In addition, a higher travel speed for tractor 64 allows more paving material to be deposited before the temperature of formed material mat 61 decreases to the extent that no further paving should be performed. If temperature sensor 68 indicates that the sensed formed material mat temperature is above a second selected temperature value, and is thus "hotter" than desired, controller 70 adjusts throttle or speed selector device 80 to decrease the travel speed of tractor 64. At a lower travel speed for tractor 64, screed assembly 66 experiences less pull from tractor 64, such that the compression force from screed assembly 66 on formed material mat 61 is reduced and screed assembly 66 is better able to form and compress the relatively "hot" paving material at a lower travel speed.

Controller 70 receives output signals from temperature sensor 68 that correspond to the temperature at specific points or sections on formed material mat 61. As discussed above, controller 70 has one or more software program(s) and/or includes hard-wired logic circuits to determine the necessary adjustment to various paver operational parameters (i.e., vibrator frequency, screed-assist pressure, etc.) to bring these operational parameters within a range that is suitable for the sensed formed material mat temperature. Controller 70 allows the paving vehicle operator to input control parameters to account for variations in paving materials and/or specific requirements for a particular paving operation.

IV. Thermal Scanning for Control of Compaction Equipment

Temperature monitoring system 10 as described above can also be incorporated into compacting vehicle or compactor 82. In this case, temperature sensor 14 of temperature monitoring system 10 is mounted on compacting vehicle or compactor 82 at a position, such as at front end 82*a*, such that temperature sensor 14 can scan or view at least a portion of formed material mat 11 to be compacted. A display device (not shown) connected with temperature sensor 14 is mounted on compacting vehicle or compactor 82 so the display device is capable of being viewed by the operator of compacting vehicle or compactor 82. Sensed formed material mat temperature data generated by temperature sensor 14 is transmitted to the display device.

As described above, one for more software program(s) and or hard-wired logic circuits process the sensed formed material mat temperature data and generate electrical signals proportional to the sensed formed material mat temperature, such that the display device provides the operator of the compacting vehicle or compactor with the temperature profile of formed material mat 11 to be compacted. Using the sensed formed material mat temperature information from the display device, the operator of compacting vehicle or compactor 82 adjusts, if necessary, one or more operational parameters of compacting vehicle or compactor 82, such as the frequency of the compaction vibrator, the travel speed of compacting vehicle or compactor 82, etc., to achieve acceptable compaction levels and smoothness in formed material mat 11. The display device preferably includes a screen, such as a cathode ray tube (CRT) (not shown), that provides the operator of compacting vehicle or compactor 82 with graphical image 17 of the sensed formed material mat temperature at particular locations or sections on formed material mat 11. An example of graphical image 17 and display information that may be presented to an operator of compacting vehicle or compactor 82 is shown, this information being similar to the information shown in FIG. 2 and discussed in connection with section I above.

Alternatively, the display device may only indicate the sensed formed material mat temperature levels in reference to a "target" or desired temperature value or range. For example, the one or more software program(s) and/or hard-wired logic circuits may compare the sensed formed material mat temperature with a "target" or desired temperature value or range, and then generate an appropriate control signal 83 that is sent to an indicator, such as, for example, "three light" indicator 84. "Three light" indicator 84 preferably includes first indicator light 86 that indicates that formed material mat 11 is at the "target" or desired temperature value or range, second indicator light 87 that indicates that the sensed formed material mat temperature is higher than the "target" or desired temperature value or range and third indicator light 88 that indicates that the sensed formed material mat temperature is lower than the "target" or desired temperature value or range. Additionally, or alternatively, an audible alarm may be used to indicate when the sensed formed material mat temperature is below the first selected temperature value or above the second selected temperature value to indicate to the operator of compacting vehicle or compactor that adjustments to the operating parameters of compacting vehicle or compactor 82 may be in order.

The operator of compacting vehicle or compactor 82 uses this information, either provided as the actual sensed formed material mat temperature or as an indicated temperature level, to adjust the operational parameters of compacting vehicle or compactor 82 as appropriate. Further the display device may either indicate the sensed formed material mat temperature averaged over the width of formed material mat 11 or formed material mat 11 may be divided into a predetermined number of sections or control zones across the width of formed material mat 11.

Output or temperature signal 83 may, alternatively, be used to automatically control operational parameters of compacting machine or compactor 82 using automatic control system or controller 90. Automatic control system or controller 90 is connected with and is capable of adjusting the operation of the device(s) (none shown) that drive the appropriate components of compacting vehicle or compactor 82, such as, for example, an electronic control valve in the hydraulic circuit operating the motor that propels compacting vehicle or compactor 82 or that drives the vibration mechanism (neither shown). If the sensed formed material mat temperature is lower than a "target" or desired temperature value the operator of compacting vehicle or compactor 82, automatic control system or controller 90 reduces the travel speed of compacting vehicle or compactor 82 and/or increases the vibration frequency. On the other hand, if the sensed formed material mat temperature is higher than a "target" or desired temperature value, automatic control system or controller 90 increases the travel speed of compacting vehicle or compactor 82 and/or decreases the vibration frequency.

The amount by which the above operational parameters are adjusted in accordance with the sensed formed material mat temperature is preferably variable and adjustable by the operator of compacting vehicle or compactor 82 to allow adjustment in variables such as variations in paving materials, operating conditions and the ambient temperature. For example, automatic control system or controller 90 may be set to increase/decrease the travel speed of compacting vehicle or compactor 82 by, for example, a specific number of rotations per minute (RPM's) for a specific number of degrees above or below, respectively the "target" or desired sensed formed material mat temperature value, with the incremental amount of increase/decrease being adjustable by the operator of compacting vehicle or compactor 82 to account for variations in paving operations.

V. Thermal Scanning for Simultaneous Paver and Compactor Control

Temperature monitoring system 10, as described herein, is mounted on paver vehicle 12. Temperature sensor 14 senses and transmits an electrical signal corresponding to the sensed formed material mat temperature. The sensed formed material mat temperature data is combined with sensed position data to automatically control operational parameters of paver vehicle 12. This data may also be stored for historical and quality assurance purposes.

Further, the sensed formed material mat temperature data and sensed position data can be transmitted by appropriate means, such as by a telemetry link (not shown), from paver vehicle 12 to compacting vehicle or compactor 82. Graphical image 17 can be displayed directly on an operator interface (e.g., a display screen) on compacting vehicle or compactor 82 such that the operator of compacting vehicle or compactor 82 uses the sensed formed material mat temperature information when controlling the operational parameters of compacting machine or compactor 82. Further, sensed formed material mat temperature information may be used to simultaneously, or alternatively, generate control signals that are inputted into one or more automatic controllers (not shown) for operating systems of compacting machine or compactor 82, such as, for example, the hydraulic motor driving the compactor vibration system (not shown).

VI. Real-Time Thermal Profile Feedback System

For any or all of the different applications of temperature monitoring system 10 described herein, temperature sensor 14 may be an infrared thermal imager configured in "line scan" mode or may be a thermal line scanner. For example, such a thermal scanner may be mounted at rear end 12*a* of paver vehicle 12 such that the field of view of the thermal scanner is formed material mat 11 being laid behind paver vehicle 12. The thermal scanner is connected with and feeds into a display device (not shown) mounted at an operator station on paver vehicle 12 so the operator of paver vehicle 12 may monitor in real time the sensed formed material mat temperature of various sections of formed material mat 11 as formed material mat 11 is being laid by paver vehicle 12. The sensed formed material mat temperature data output from the thermal scanner may be recorded onto high capacity discs and/or cards (not shown) and maintained as a historical record of the thermal profile of formed material mat 11 as laid.

Temperature monitoring system 10 is preferably designed such that the thermal scanner only records or displays sensed formed material mat temperature information when paver vehicle 12 is in motion. Further, the forward speed of paver vehicle 12 may be simultaneously recorded and processed to allow the position of paver vehicle 12 to be determined and the sensed formed material mat temperature profile cross-referenced or correlated to specific positions on formed material mat 11.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A method of operating a paver vehicle in forming a mat of paving material upon a base surface, the paver vehicle including a tractor operable at various travel speeds with respect to the base surface and a screed that is connected with the tractor, the method comprising the steps of:

providing a temperature sensor connected with the paver vehicle;

sensing the temperature of the formed material mat; and adjusting the travel speed of the tractor so as to vary the speed of formation of the formed material mat in accordance with a predetermined relationship between the sensed formed material mat temperature and the travel speed of the tractor.

2. A method in accordance with claim 1 further comprising the steps of:

providing the paver vehicle with a tractor and a screed that is connected with the tractor and the screed is adjustable so as to vary the compressive force exerted by the screed on the formed material mat adjusting the screed during formation of the formed material mat so as to vary the compressive force exerted by the screed upon the formed material mat in accordance with a predetermined relationship between the sensed formed material mat temperature and the compressive force exerted by the screed.

3. The operating method in accordance with claim 2, wherein the step of adjusting the screed includes increasing the compressive force exerted by the screed when the sensed formed material mat temperature is below a first selected temperature value and decreasing the compressive force exerted by the screed when the sensed formed material mat temperature is above a second selected temperature value.

4. The operating method in accordance with claim 2, wherein the screed includes a vibrator device that is operable at various frequencies and the step of adjusting the screed includes increasing the operating frequency of the vibrator device when the sensed formed material mat temperature is below a first selected temperature value and decreasing the operating frequency of the vibrator device when the sensed temperature is above a second selected temperature value.

5. The operating method in accordance with claim 2, wherein the screed includes a vibrator device that is operable at various amplitudes and the step of adjusting the screed includes increasing the operating amplitude of the vibrator device when the sensed formed material mat temperature is below a fist selected temperature value and decreasing the operating amplitude of the vibrator device when the sensed formed material mat temperature is above a second selected temperature value.

6. The operating method in accordance with claim 2, wherein the screed includes a tamper device operable at various frequencies and the step of adjusting the screed includes increasing the operating frequency of the tamper device when the sensed formed material mat temperature is below a first selected temperature value and decreasing the operating frequency of the tamper device when the sensed formed material mat temperature is above a second selected temperature value.

7. The operating method in accordance with claim 2, wherein the screed includes a tamper device having an adjustable amplitude and the step of adjusting the screed includes increasing the operating amplitude of the tamper device when the sensed formed material mat temperature is below a first selected temperature value and decreasing the operating amplitude of the tamper device when the sensed formed material mat temperature is above a second selected temperature value.

8. The operating method in accordance with claim 2, wherein the paver vehicle includes a hydraulic cylinder having a first end connected with the tractor and a second end connected with the screed and the step of adjusting the screed includes extending the hydraulic cylinder when the sense formed material mat temperature is below a first selected temperature value and retracting the hydraulic cylinder when the sensed formed material mat temperature is above a second selected temperature value.

9. The operating method in accordance with claim 2, wherein said temperature sensor is a thermal imager or a thermal scanner configured to sense the formed material mat temperature profile of a section of the formed material mat.

10. The operating method in accordance with claim 2, further including the steps of providing a display device disposed on the paver vehicle and generating a graphical image on said display device which is representative of the sensed formed material mat temperature and wherein the step of adjusting the screed includes manually adjusting the screed.

11. The operating method in accordance with claim 2, further including the step of providing a controller disposed an the paver vehicle and connected with the temperature sensor and wherein:

the temperature sensor is configured to send an electrical signal representative of the sensed formed material mat temperature to the controller, the screed includes an actuator electrically connected with the controller, the actuator configured to adjust the screed to vary the compressive force exerted by the screed; and the step of adjusting the screen includes operating the actuator with the controller in response to the electrical signal received from the temperature sensor so as to automatically adjust the screed.

12. The operating method in accordance with claim 1, wherein the step of adjusting the travel speed of the tractor includes increasing the travel speed of the tractor when the sensed formed material mat temperature is below a first selected temperature value and decreasing the travel speed of the tractor when the sensed formed material mat temperature is above a second selected temperature value.

13. The operating method in accordance with claim 1, wherein:

the tractor includes a plurality of wheels configured to mobilize the tractor upon the base surface, a motor configured to drive the wheels at various operating speeds, and a throttle configured to adjust the speed of the wheels; and the step of adjusting the travel speed of the tractor includes operating the throttle to adjust the speed of the wheels.

14. The operating method in accordance with claim 1, further including the step of providing a controller disposed on the paver vehicle and connected with the temperature sensor and wherein:

the temperature sensor is configured to send an electrical signal representative of the sensed formed material mat temperature to the controller;

the tractor includes an actuator electrically connected with the controller and configured to adjust the travel speed of the tractor, and the step of adjusting the travel speed of the tractor includes operating the actuator with the controller in response to the electrical signal received from the temperature sensor so as to automatically adjust the travel speed of the tractor.

15. The operating method in accordance with claim 1, wherein the temperature sensor is a thermal imager or a thermal scanner configured to sense the formed material mat temperature profile of a section of the formed material mat.

16. A marking system for a paver vehicle for forming a mat of paving material upon a base surface, said marking system comprising:

a temperature sensor connected with the paver vehicle, said temperature sensor configured to sense a temperature of the formed material mat and generating an electrical signal representative of the sensed temperature;

a marking advice mounted to the paver vehicle, said marking device configured to form a visible mark on the formed material mat; and a controller disposed on the paver vehicle, said controller is electrically connected with the temperture sensor and operates said marking device such that said marking device forms a visible mark on the formed material mat when the sensed temperature is below a first selected temperature value or above a second selected temperature value.

17. The marking system in accordance with claim 16, wherein said temperature sensor is a non-contact temperature sensor.

18. The marking system in accordance with claim 17, wherein said temperature sensor is a thermal imager.

19. The marking system in accordance with in claim 17, wherein:

said temperature sensor is a thermal scanner configured to sense the temperature at a plurality of locations on the formed material mat; and said controller operates said marking device such that said marking device forms a visible mark on the formed material mat at each location on the formed material mat where the sensed temperature is below said first selected temperature value or above said second selected temperature value.

20. The marking system in accordance with claim 16, wherein said marking device includes a supply of paint and a paint sprayer connected with said supply of paint and said paint sprayer directs a predetermined quantity of paint onto the formed material mat at least proximal to the location on the formed material mat where the sensed temperature is below a first selected temperature value or above a second selected temperature value.

21. The marking device in accordance with claim 20, wherein the paver vehicle forms the formed material mat as a continuous strip having a width and said paint sprayer includes a plurality of paint delivery nozzles a are arranged on the paver vehicle so as to be spaced across the width of the formed material mat.

22. The marking device in accordance with claim 16, wherein:

said marker device forms a first mark and a visually distinguishable second mark; and said controller operates said marker device such that said marker device forms said first mark on the formed material mat when the sensed temperature is below said first selected temperature value and said marker device forms said second mark on the formed material mat when the sensed temperature is above said second selected temperature value.

23. A control system for a paver vehicle for forming a mat of paving material upon a base surface, the paver vehicle including a tractor operable at various travel speeds with respect to the base surface, the travel speed of the tractor speed determining the speed of formed material mat formation, and a screed connected with the tractor, said control system comprising:

a temperature sensor connected with the paver vehicle, said temperature sensor configured to sense a temperature of the formed material mat and generating an electrical signal representative of the sensed formed material mat temperature;

means for varying the travel speed of the tractor; and a controller disposed on the paver vehicle, said controller is electrically connected with said temperature sensor and controls said means for varying the travel speed of the tractor in accordance with a predetermined relationship between the sensed formed material mat temperature and the travel speed of the tractor.

24. The control system in accordance with claim 23, wherein said controller increases the travel speed of the tractor when the sensed formed material mat temperature is below a first selected temperature value and decreases the travel speed of the tractor when the sensed formed material mat temperature is above a second selected temperature value.

25. The control system in accordance with claim 23, wherein:

the tractor includes a plurality of wheels that mobilize the tractor upon the base surface, a motor to drive the wheels, said motor being operable at various speeds, and a throttle to control the speed of the motor; and said controller adjusts the throttle so as to adjust the speed of formed material mat formation.

26. The control system in accordance with claim 23, wherein:

the paver vehicle includes a rotatable auger connected with the tractor for spreading paving material across the base surface and a conveyor mounted on the tractor and configured for transporting paving material toward the screed; and said controller is connected with said rotatable auger and with said conveyor and said controller increases the speed of said rotatable auger and the speed of said conveyor when the tractor sped is increased and decreases the speed of said rotatable auger and the speed of said conveyor when the tractor speed is decreased.

27. The control system in accordance with claim 23, wherein said temperature sensor is a non-contact temperature sensor.

28. The control system in accordance with claim 23, wherein said temperature sensor is a thermal imager.

29. The control system in accordance with claim 23, wherein said temperature sensor is a thermal scanner configured to sense formed material mat temperature at a plurality of locations on a section of the formed material mat.

30. The control system in accordance with claim 23, further comprising a display device disposed on the paver vehicle, said display device is electrically connected with said controller and said thermal scanner transmits a plurality of electrical signals to said controller, each of said plurality of electrical signals being representative of the sensed material mat temperature at a particular location on the formed material mat, and said controller generates a graphical image on said display device corresponding to said plurality of electrical signals, the graphical image being representative of the sensed formed material mat temperature at a plurality of formed material mat locations so as to provide a viewable thermal profile of the formed material mat section.

31. A control system in accordance with claim 23 further comprising, a display device disposed on the paver vehicle and electrically connected with said temperature sensor; said display device receives said electrical signal from said temperature sensor and displays a graphical image from said electrical signal, the graphical image being representative of sensed temperature.

32. The control system in accordance with claim 31, further comprising:

a position sensor disposed on the paver vehicle, said position sensor configured to sense the position of the paver vehicle with respect to the base surface; and means for correlating sensed paver vehicle position with sensed formed material mat temperature and for providing the sensed formed material mat temperature for a particular sensed paver vehicle position; and database means for storing the sensed formed material mat temperature and sensed paver vehicle position information.

33. The control system in accordances with claim 31, wherein said temperature sensor is a thermal imager.

34. The control system in accordance with claim 32, wherein said temperature sensor is a thermal scanner configured to sense the temperature at a plurality of locations on the formed material mat and generating a plurality of electrical signals, each of said plurality of electrical signals being representative of the sensed formed material mat temperature at a particular sensed paver vehicle position.

35. The control system in accordance with claim 34, wherein said display device receives said plurality of electrical signals and generates and displays a graphical image representative of a sensed thermal profile of a section of the formed material mat based on said plurality of signals, the formed material mat section including a plurality of sensed formed material mat locations.

36. The control system in accordance with claim 35, wherein:

the paver vehicle forms the formed material mat as the paver vehicle travels generally in a single direction such that the formed material mat is formed as a continuous strip having a width transverse to the direction of travel of the paver vehicle;

said thermal scanner repeatedly scanning across at least a portion of the width of the formed material mat so as to periodically sense the formed material mat temperature at successive sections of the formed material mat along the direction of travel of the paver vehicle; and said display device periodically updating the graphical image to represent the formed material mat temperature at successive sections of the formed material mat.

37. The control system in accordance with claim 31, wherein said display device is a cathode ray tube (CRT) display device or a liquid crystal display (LCD) display device.

38. A control system in accordance with claim 23 further comprising:

a tractor and a screed connected with the tractor, the screed being configured to form paving material deposited off of the tractor into a formed material mat ;and means for varying the compressive force exerted by the screed on the formed material mat;

wherein said controller operates said means for varying the compressive force exerted by the screed on the formed material mat in accordance with a predetermined relationship between sensed formed material mat temperature and the compressive force exerted by the screed.

39. The control system in accordance with claim 38, wherein the screed includes a screed plate, said means for varying the compressive force exerted by the screed on the formed material mat is a vibrator device mounted on the screed plate which is operable at various frequencies and said controller increases the vibration frequency of said vibrator device when the sensed formed material mat temperature is below a first selected temperature value and decreases the vibration frequency of said vibrator device when the sensed formed material mat temperature is above a second selected temperature value.

40. The control system in accordance with claim 38, wherein the screed includes a screed plate, said means for varying the compressive force exerted by the screed on the formed material mat is a vibrator device mounted on the screed plate that is operable at various amplitudes and said controller increases the amplitude of said vibrator device when the sensed formed material mat temperature is below a first selected temperature value and decreases the amplitude of said vibrator device when the sensed formed material mat temperature is above a second selected temperature value.

41. The control system in accordance with claim 38, wherein said means for varying the compressive force exerted by the screed on the formed material mat is a tamper bar that is operable at various frequencies and said controller increases the frequency of said tamper bar when the sensed formed material mat temperature is below a first selected temperature value and decreases the frequency of the tamper bar when the sensed formed material mat temperature is above a second selected temperature value.

42. The control system in accordance with claim 38, wherein said means for varying the compressive force exerted by the screed on the formed material mat is a tamper bar that is operable at various amplitudes and said controller increases the amplitude of said tamper bar when the sensed formed material mat temperature is below a first selected temperature value and decreases the amplitude of the tamper bar when the sensed formed material mat temperature is above a second selected temperature value.

43. The control system in accordance with claim 38, wherein said means for varying the compressive force exerted by the screed on the formed material mat includes a hydraulic cylinder extending between the tractor and the screed and said hydraulic cylinder vertically displaces the screed plate and said controller extends said hydraulic cylinder when the sensed formed material mat temperature is below a first selected temperature value and retracts said hydraulic cylinder when the sensed formed material mat temperature is above a second selected temperature value.

44. The control system in accordance with claim 38, wherein said temperature sensor is a non-contact temperature sensor.

45. The control system in accordance with claim 38, wherein said temperature sensor is a thermal imager.

46. The control system in accordance with claim 38, wherein said temperature sensor is a thermal scanner that senses the formed material mat temperature at a plurality of locations on a section of the formed material mat.

47. The control system in accordance with claim 46, further comprising a display device disposed on the paver vehicle, said display device is electrically connected with said controller and said thermal scanner transmits a plurality of electrical signals to said controller, each of said plurality of electrical signals being representative of the sensed formed material mat temperature at a particular location on said formed material mat, and said controller generates a graphical image on said display device corresponding to said plurality of electrical signals, said graphical image being representative of the sensed formed material mat temperature at a plurality of formed material mat locations so as to provide a viewable thermal profile of the formed material mat section.

* * * * *

UNITED STATES PATENT AND TRADEMARK OFFICE

CERTIFICATE OF CORRECTION

PATENT NO. : 6,749,364 B1
DATED : June 15, 2004
INVENTOR(S) : Adrian Baker et al.

It is certified that error appears in the above-identified patent and that said Letters Patent is hereby corrected as shown below:

Title page,
Item [57], ABSTRACT,
Line 6, delete “line “scan”” and replace with -- “line scan” --.

Column 1,
Line 5, delete “This-application and replace with -- This application --.

Column 3,
Line 49, delete “a”.

Column 4,
Line 66, delete “i” and replace with -- a --.

Column 5,
Line 57, delete “Seal-time” and replace with -- “real-time” --.

Column 6,
Line 14, delete “ray” and replace with -- may --.
Line 20, delete “as”.

Column 10,
Line 17, delete “-on” and replace with -- on --.

Column 11,
Line 62, delete “optical” and replace with -- optimal --.

Column 12,
Line 41, delete “79” and replace with -- 78 --.

Column 15,
Line 34, after “respectively”, insert -- , --.

Column 16,
Line 53, after “mat”, insert -- ; and --.

UNITED STATES PATENT AND TRADEMARK OFFICE

CERTIFICATE OF CORRECTION

PATENT NO. : 6,749,364 B1
DATED : June 15, 2004
INVENTOR(S) : Adrian Baker et al.

It is certified that error appears in the above-identified patent and that said Letters Patent is hereby corrected as shown below:

Column 17,
Line 14 delete “fist” and replace with -- first --.
Line 41, delete “sense” and replace with -- sensed --.
Line 58, delete “an” and replace with -- on --.
Line 67, delete “screen” and replace with -- screed --.

Column 19,
Line 18, delete “a”, second occurrence, and replace with -- that --.

Column 20,
Line 11, delete “sped” and replace with -- speed --.

Signed and Sealed this

Twenty-third Day of November, 2004

JON W. DUDAS
*Director of the United States Patent and Trademark Office*